United States Patent [19]

Milligan

[11] 4,431,996

[45] Feb. 14, 1984

[54] MISSILE MULTI-FREQUENCY ANTENNA

[75] Inventor: Thomas A. Milligan, Littleton, Colo.

[73] Assignee: The United States of America as represented by the Secretary of the Air Force, Washington, D.C.

[21] Appl. No.: 326,975

[22] Filed: Dec. 3, 1981

[51] Int. Cl.[3] ..... H01Q 1/28

[52] U.S. Cl. ..... 343/708; 343/769

[58] Field of Search ..... 343/708, 769, 789, 700 MS, 343/768, DIG. 2, 770, 771

[56] References Cited

U.S. PATENT DOCUMENTS

| | | | |
|---|---|---|---|
| Re. 29,296 | 7/1977 | Krutsinger et al. | 343/700 MS |
| 3,074,063 | 1/1963 | Horton | 343/708 |
| 3,739,386 | 6/1973 | Jones, Jr. | 343/708 |
| 3,805,266 | 4/1974 | Fletcher et al. | 343/708 |
| 4,051,480 | 9/1977 | Reggia et al. | 343/700 MS |
| 4,229,744 | 10/1980 | Luedtke et al. | 343/769 |

*Primary Examiner*—Eli Lieberman
*Assistant Examiner*—Michael C. Wimer
*Attorney, Agent, or Firm*—Donald J. Singer; Willard R. Matthews, Jr.

[57] ABSTRACT

A multifrequency antenna for a missile is realized by an arrangement in which four microwave antennas are located under a narrow circumferential slot in the skin of the missile forming four separate antennas each with its own input connector. Each antenna consists of a probe fed annular quarter wavelength microwave cavity which radiate out of a top wall end slot. The cavity antennas are fed by a stripline distribution network directly under the antennas. Two L band antennas are positioned directly adjacent the inner surface of the missile skin and an S band antenna and a C band antenna are positioned beneath the L band antennas. A radome covers the circumferential slot.

7 Claims, 5 Drawing Figures

FIG. 2
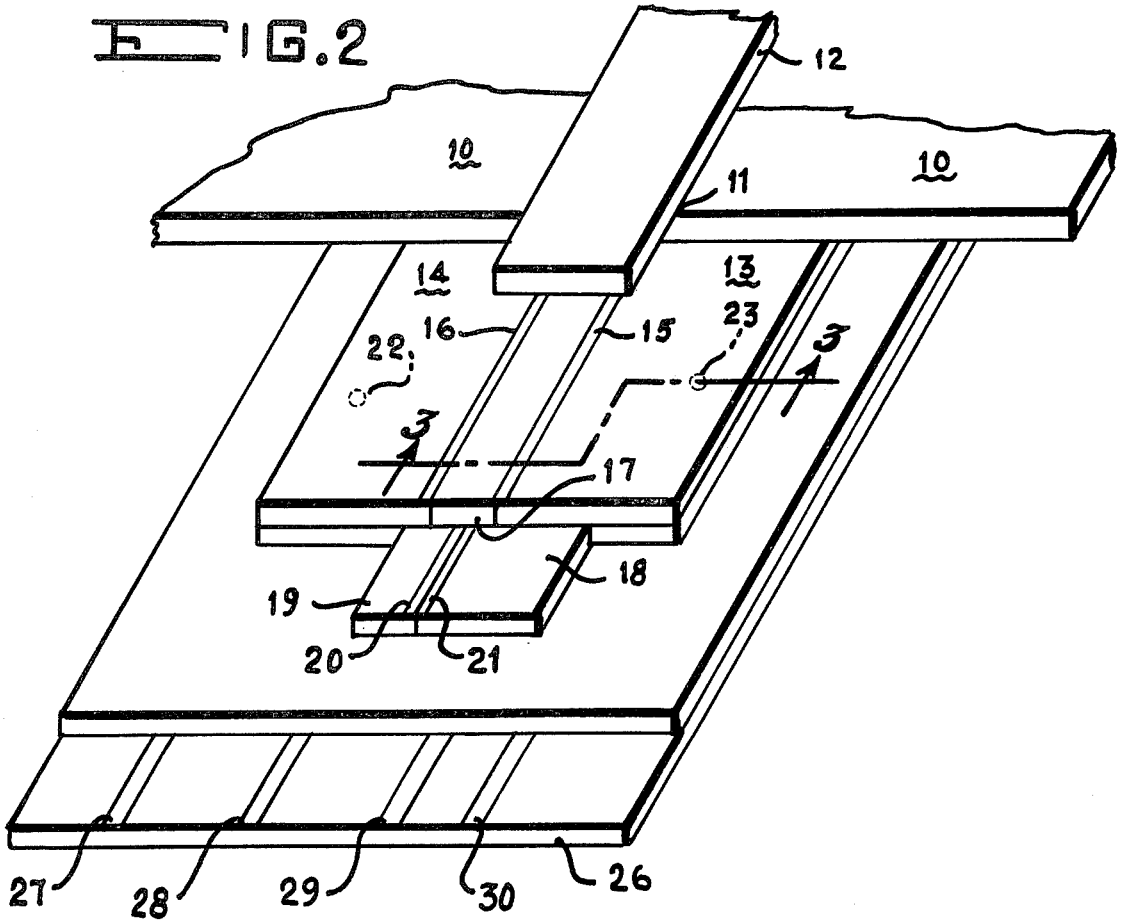
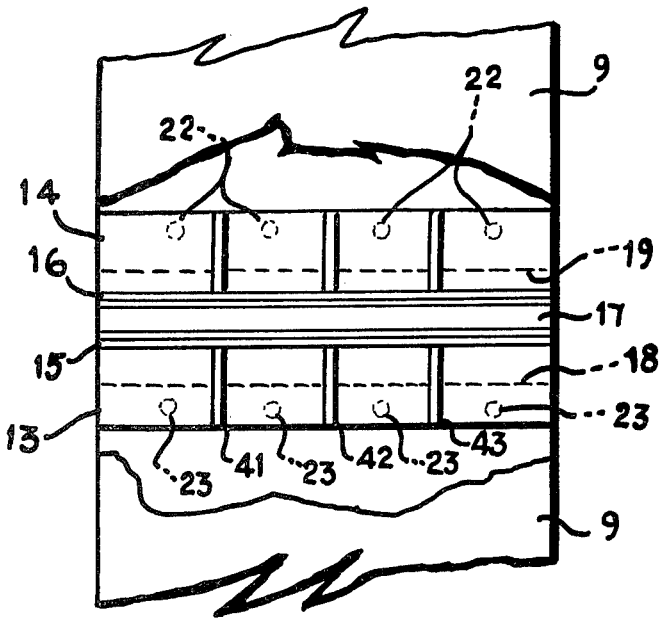
FIG. 5

MISSILE MULTI-FREQUENCY ANTENNA

STATEMENT OF GOVERNMENT INTEREST

The invention described herein may be manufactured and used by or for the Government for governmental purposes without the payment of any royalty thereon.

BACKGROUND OF THE INVENTION

This invention relates to microwave antennas and in particular to slot radiating antennas for use on spacecraft and missiles.

It is current practice to mount microstrip patch antennas with their associated feeder networks on the outside of the space vehicle to accommodate single or multiple frequency microwave transmissions. Such a practice introducers an aerodynamic discontinuity to the fuselage thus affecting missile performance. Furthermore, the antenna elements are subjected to rapidly changing adverse environmental conditions thus reducing their reliability. Even the use of radomes which, to some extent protects antanna elements and aleviates the aerodynamic problem does not fully solve the problem. In addition, mounting microstrip patch antennas and their associated feeder networks on the outside of the vehicle requires that the antenna be a half wavelength long in the dielectic of the antenna plus the width of the microstrip feeder network. For each frequency there is a separate antenna patch and feeder network. Thus, with multiple frequencies the problem is severely compounded.

In view of the foregoing it is seen that there currently exists the need for a multifrequency antenna that can be mounted on a space vehicle without sacrificing vehicle aerodynamic integrity or subjecting antenna elements to adverse environmental conditions. It is also important that such an antenna utilize minimum axial length of the vehicle.

The present invention is directed toward satisfying that need.

SUMMARY OF THE INVENTION

The invention is a multiple frequency antenna for a missile. It is implemented by cutting a strip aperture in the outer missile skin. The aperture encompasses the missile body. A plurality of annular microwave cavities are positioned adjacent the inner surface of the missile skin in the vicinity of the strip aperture. Each cavity has a circumferential top end slot for radiating microwave energy and is fed by a stripline feed circuit. The cavities are oriented such that the top end slots are substantially in register with, and radiate microwave energy through, the strip aperture. Two L band cavities are immediately adjacent the inner skin surface and are separated by a radome. An S band cavity and a C band cavity are positioned below and contiguous to the L band cavities and are adjacent to each other. Another radome covers the strip aperture.

It is a principal object of the invention to provide a new and improved missile multi-frequency microwave antenna.

It is another object of the invention to provide a missile multi-frequency microwave antenna that can be incorporated into the missile body without sacrificing vehicle aerodynamic integrity.

It is another object of the invention to provide a missile multi-frequency microwave antenna that is rugged and reliable and not subject to extreme adverse environmental conditions.

It is another object of the invention to provide a missile multifrequency microwave antenna that utilizes minimum axial length of the vehicle.

These together with other objects, features and advantages of the invention will become more readily apparent from the following detailed description when taken in conjunction with the illustrative embodiments in the accompanying drawings.

DESCRIPTION OF THE DRAWINGS

FIG. 2 is an an isometric cutaway view of the multifrequency antenna of the invention;

FIG. 5 is a view of the missile of FIG. 1 with a cutaway showing details of a second embodiment of the multi-frequency antenna of the invention.

DETAILED DESCRIPTION OF THE PREFERRED EMBODIMENT

The presently preferred embodiment of the invention is an antenna which radiates at four frequencies with separate inputs for each antenna frequency. There are two separated L Band frequencies, an S Band frequency, and a C Band frequency. Each antenna frequency consists of a quarterwave cavity which radiates out of a top wall end slot. The cavities are excited by a probe from a coaxial feed line. The inner conductor of the coaxial feed line is shorted to the top wall of the cavity and the outer conductor is shorted to the lower wall of the cavity. The location of the connection is picked to impedance match the radiating cavity to the coaxial feeder. The two L Band cavities are located on the top surface under the radome and the radiating slots are separated to allow the S and C Band slots below to radiate through the radome and to reduce the coupling between the L Band cavities. The L Band cavities extend beyond the S and C Band cavities below and are probe fed from below by the stripline distribution network. The S and C Band cavities are located below the L Band cavities and radiate from slots under the gap left between the L Band cavities. The slots for the S and C Bands are located exactly next to each other. The two cavities do not couple because they are not harmonically related in frequency. The S and C Band cavities are also probe fed by the stripline feeder network below. The antenna and stripline distribution network can conveniently be made from a low loss microwave printed curcuit board material and the slots and the stipline network can be photo etched or machined out of the metal plating. The cavities formed are continuous around the vehicle and are fed in enough places around the vehicle to give a uniform voltage across the slot all the way around the vehicle. The antenna can be broken into separate panels by cutting along a line half way between two feeder probes to the antenna cavities.

Figure 1:
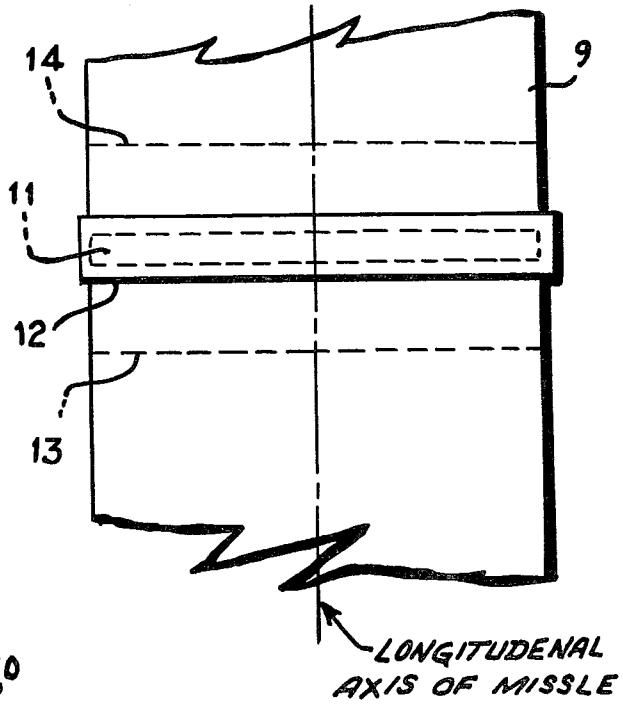
FIG. 1 is a partial side view of a missile incorporating the multifrequency antenna of the invention.

Referring now to FIG. 1 there is illustrated thereby a partial side view of a missile 9 incorporating the multifrequency antenna of the invention. FIG. 1 shows radome 12, the circumferential slot 11 (by dashed lines) in the outer skin of the missile and L Band cavities 13 and 14 (also by dashed lines).

Figure 3:
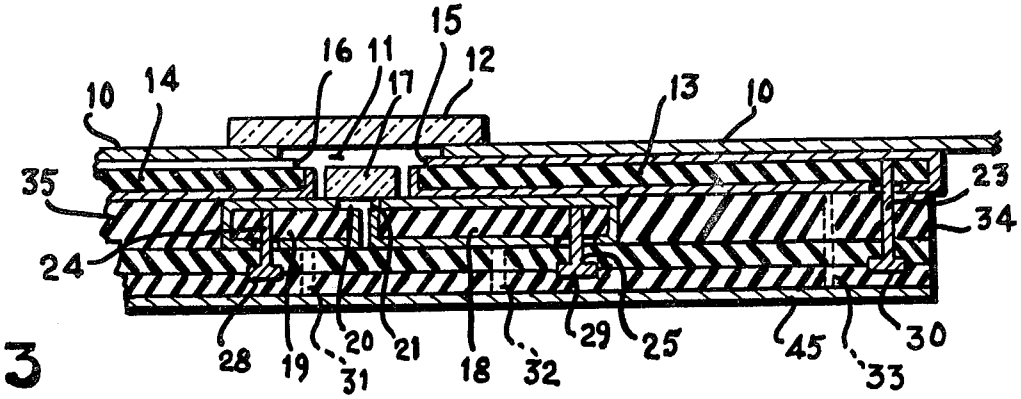
FIG. 3 is a sectional view of the multifrequency antenna of FIG. 2 taken at 3—3.

FIGS. 2 and 3 illustrate the multifrequency antenna of the invention in detail. Referring thereto circumferential slot 11 is cut into outer skin 10 of the missile and encircles the missile body (as shown in FIG. 1). Annular L Band cavities 13 and 14 are positioned adjacent missile skin 10 and separated from each other by a space that is filled with radome 17. L Band cavities 13 and 14 have top wall end slots 15 and 16 respectively that radiate microwave energy. Annular S Band cavity 18 having a top wall end slot 21 and annular C Band cavity 19 having a top wall end slot 20 are positioned below and adjacent to L Band cavities 13 and 14 as shown. Strip line feed network 26 is positioned adjacent cavities 18, 19 and includes feeds 27, 28, 29 and 30 which feed cavities 14, 19, 18 and 13 respectively through probes 22, 24, 25 and 23. The ground plate 45 of stripline feed network 26 is shorted to the top walls of the cavities by means of shorting pins 31–33. Spacer 34, 35 provide mechanical strength to the antenna structure.

Figure 4:
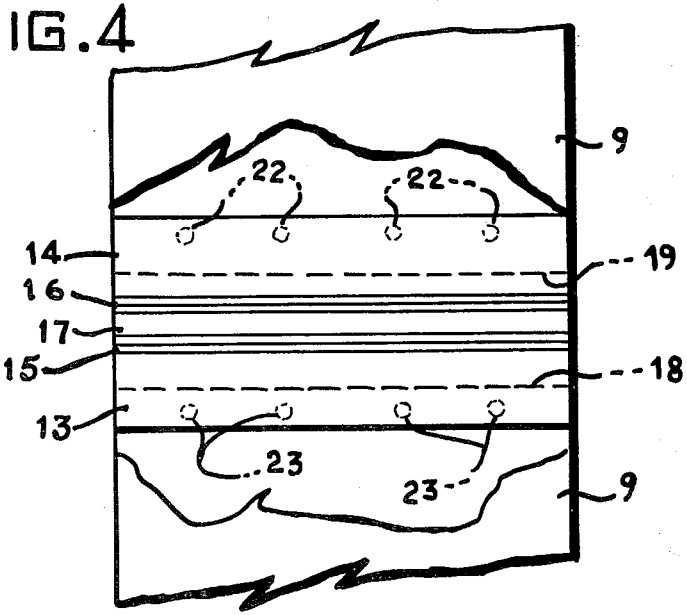
FIG. 4 is a view of the missile of FIG. 1 with a cutaway showing details of the multifrequency antenna of the invention.

FIG. 4 is a cutaway view of FIG. 1 showing cavities 13, 14 and in particular the arrangement of multiple probes 22, 23 that provide uniform voltage across the slot as discussed above.

FIG. 5 is another cut away view of the antenna similar to FIG. 4 showing the division of cavities 13, 14 into separate panels by means of cuts 41, 42, 43.

While the invention has been described in one presently preferred embodiment it is understood that the words which have been used are words of description rather than words of limitation and that changes within the purview of the appended claims may be made without departing from the scope and spirit of the invention in its broader aspects.

What is claimed is:

1. In a spacecraft, a multiple frequency antenna comprising a transverse circumferential strip aperture in the outer skin of said spacecraft, a plurality of quarter wavelength annular microwave cavities, each cavity having a circumferential micro-wave energy radiating slot, said cavities being positioned proximate the inner surface of said spacecraft outer skin, the radiating slot of each said cavity being substantially in register with and oriented to transmit microwave energy through said circumferential strip aperture, and means for feeding microwave energy to said cavities.

2. A multiple frequency antenna as defined in claim 1 including a first radome covering said circumferential strip aperture.

3. A multiple frequency antenna as defined in claim 2 wherein said plurality of quarter wavelength annular microwave cavities comprise:

a first cavity operating at a first frequency band, a second cavity operating at a second frequency band, a third cavity operating at a third frequency band, and a fourth cavity operating at a fourth frequency band, the microwave energy radiating slot of each cavity being a top wall end slot, said first and second cavities being in spaced juxtaposed relationship and adjacent the inner surface of said spacecraft outer skin, the top wall end slots thereof being adjacent, said multiple frequency antenna including a second radome between said first and second cavities, and said third and fourth cavities being in proximate juxtaposed relationship and adjacent said first and second cavities, the top wall end slots thereof being adjacent and in register with said second radome.

4. A multiple frequency antenna as defined in claim 3 wherein said means for feeding microwave energy comprises a stripline circuit adjacent said third and fourth cavities, and probe means coupling said first, second, third and fourth cavities to said stripline feed circuit.

5. A multiple frequency antenna as defined in claim 4 wherein said first and second cavities operate at L band, said third cavity operates at S band and said fourth cavity operates at C band.

6. A multiple frequency antenna as defined in claim 5 wherein said probe means comprises multiple probe elements spaced to effect uniform voltage over the length of each cavity radiating slot.

7. A multiple frequency antenna as defined in claim 6 wherein each said cavity is segmented between feeder probe elements.

* * * * *